US010012372B2

(12) United States Patent
Marie et al.

(10) Patent No.: US 10,012,372 B2
(45) Date of Patent: Jul. 3, 2018

(54) PORTABLE LAMP COMPRISING AN IMPROVED LOCKING MECHANISM

(71) Applicant: Zedel, Crolles (FR)

(72) Inventors: Christophe Marie, Le Versoud (FR); Raphael Bortolotti, Annecy le Vieux (FR)

(73) Assignee: Zedel, Crolles (FR)

( * ) Notice: Subject to any disclaimer, the term of this patent is extended or adjusted under 35 U.S.C. 154(b) by 0 days.

(21) Appl. No.: 15/398,161

(22) Filed: Jan. 4, 2017

(65) Prior Publication Data

US 2017/0191646 A1 Jul. 6, 2017

Related U.S. Application Data

(60) Provisional application No. 62/275,401, filed on Jan. 6, 2016.

(30) Foreign Application Priority Data

Jan. 4, 2016 (EP) ..... 16150107

(51) Int. Cl.
*F21V 23/04* (2006.01)
*H05B 33/08* (2006.01)
(Continued)

(52) U.S. Cl.
CPC ..... *F21V 23/0414* (2013.01); *F21V 21/084* (2013.01); *F21V 23/0407* (2013.01);
(Continued)

(58) Field of Classification Search
None
See application file for complete search history.

(56) References Cited

U.S. PATENT DOCUMENTS 5,931,562 A 8/1999 Arato
7,303,306 B2 12/2007 Ross et al.
(Continued)

FOREIGN PATENT DOCUMENTS

EP 0 637 718 2/1995
WO WO 2008/036943 3/2008

OTHER PUBLICATIONS

European Search Report, Application No. 16150107.7-1802, Applicant: Zedel S.A., dated May 19, 2016, 7 pgs.

*Primary Examiner* — Jany Richardson
(74) *Attorney, Agent, or Firm* — Saile Ackerman LLC; Stephen B. Ackerman

(57) ABSTRACT

A headlamp with a light source, an electrical power source and several states controlling power sources and light beams is presented.
The first state corresponds to at least one activated state in which the electrical power source is coupled to a light source to generate a light beam.
The second state corresponds to a deactivated state where the electrical power source is not coupled to a light source and no light beam is generated.
The third state corresponds to a locked state in which the electrical power source is not coupled to a light source and no light beam is generated;
Also included is a switching mechanism to receive a first and a second physical user input through one switching element. A processor is coupled to the switching mechanism and is used to select one among the first, second and third states in response to the physical user inputs.

20 Claims, 10 Drawing Sheets

(51) Int. Cl.

| | |
|---|---|
| ***H05B 37/02*** | (2006.01) |
| ***F21V 21/084*** | (2006.01) |
| *F21L 4/00* | (2006.01) |

(52) U.S. Cl.
CPC ..... *H05B 33/0845* (2013.01); *H05B 33/0848* (2013.01); *H05B 37/0227* (2013.01); *F21L 4/00* (2013.01)

(56) References Cited

U.S. PATENT DOCUMENTS

| | | | | |
|---|---|---|---|---|
| 8,378,587 | B2 | 2/2013 | Huguenin et al. | |
| 8,529,086 | B2 | 9/2013 | Skrivan et al. | |
| 2011/0012534 | A1 | 1/2011 | West et al. | |
| 2011/0204826 | A1 | 8/2011 | Skrivan et al. | |
| 2012/0002691 | A1* | 1/2012 | Tao ..... | F21L 4/00 372/38.07 |
| 2014/0146552 | A1 | 5/2014 | Hui | |

* cited by examiner

PORTABLE LAMP COMPRISING AN IMPROVED LOCKING MECHANISM

TECHNICAL FIELD

The present invention relates to the field of portable electric lamps and in particular a headlamp fitted with an improved locking mechanism.

BACKGROUND

There are quite a number of known effective techniques for controlling the operation of conventional electric devices, such as a standing lamp.

The use of a mechanical locking mechanism has been a solution which has been widely used, by the Applicant of the present invention, so as to prevent inadvertent power-on of the lamp when, for instance, the latter is stored in a bag. A first example of such a system is described in European patent application EP19940410060 filed on 2 Aug. 1994 (Publication EP0637718). A second example of such a known lamp is also illustrated in FIG. 1 which shows a headlamp 10 fitted with a rotary switch 15 which may be rotated between different distinct positions 11, 12, 13 and 14. Positions 11 and 12 correspond to two modes of operations having different levels of brightness, while position 13 is a OFF position. At last, an extreme position 14 corresponds to a locking position configured so that to provide a position where the switch 15 can not be inadvertently rotated.

Such a mechanical locking is quite important so as to prevent undesired use of the battery. However, electrical locking mechanisms were used as well in the past for preventing unintended use and activation of the lamp when the latter is stored.

WO 2008/036943 filed on Sep. 21, 2007, shows the use of an electrical locking mechanism fitted inside a prior art flashlight device 100, as represented in FIG. 2. More particularly, the flashlight is operated by the use of two buttons 144 and 146, respectively corresponding to a momentary "on" or a constant "on" which can be used for different modes of operation. The flashlight of FIG. 2 includes a "lockout" mechanism to ensure that anyone of those two buttons are not inadvertently depressed while the flashlight is stored in a bag, thus draining the batteries. The flashlight is configured to activate the "lockout" mechanism by simultaneously depressing the constant "on" button 146 and another button 148, and released in the same manner. This ensures that the flashlight device 100 is not inadvertently on while being stored and is ready for use when needed by the user. In one embodiment, the flashlight includes a control panel showing one indicator lamp to provide visible indication of the "lockout" status as to whether the flashlight device is "locked" or "unlocked", e.g. by illuminating a symbol or icon in the upper surface of the keypad overlay.

U.S. Pat. No. 7,303,306 filed on Oct. 28, 2005 illustrates another example of an electrical locking mechanism used in a flashlight, which is activated by simultaneously depressing two different switches.

U.S. Ser. No. 12/502,237 filed on Jul. 14, 2009 further illustrates the use of an electrical locking mechanism.

U.S. Pat. No. 8,529,086 filed on Sep. 10, 2013 illustrates a portable illumination system having a locked stated that minimizes the occurrence of unintended activation. The patent describes and claims:

"a portable illumination system comprising:

at least one light source;

an electrical power source, a first activated state in which the electrical power source is coupled to the at least one light source to generate a first optical output;

a deactivated state in which the electrical power source is not coupled to the at least one light source and no optical output is generated;

a locked state in which the electrical power source is not coupled to the at least one light source and no optical output is generated;

a switching mechanism configured to receive both a first and second physical user input;

a processor coupled to the switching mechanism, the processor configured to select one of the first activated state, the deactivated state, and the locked state in response to one of the first and second physical user input;

wherein the processor is configured to correlate the first physical user input with a state change between the first activated activated state and the deactivated state; and wherein the processor is configured to correlate only the second physical user input with a state change between the locked state and either one of the first activated state or the deactivated state"

U.S. Pat. No. 8,529,086 further describes and claims a corresponding method for switching between operational states of a portable illumination system.

All the electrical locking mechanisms known in the prior art, including U.S. Pat. No. 8,529,086 show to be quite effective for preventing unintended use of the lamp.

However, all those conventional mechanisms only arrange one single path for unlocking the lamp, which is shown to be too limited in view of the new possibilities of control of portable illumination systems.

SUMMARY

There is a desire to provide an enhanced unlocking mechanism, and more generally an improved user interface for controlling the operations of a portable illumination system such as a headlamp.

It is an object of the present invention to provide a portable illumination system, such as a headlamp having an improved user interface which is fitted with an effective locking mechanism.

It is another object of the present invention to a headlamp which is fitted with a powerful user interface while only comprising a limited number of mechanical switching elements.

It is a further object of the present invention to provide a headlamp which provides various activated modes, together with a deactivated mode and a locked mode, and allows flexible switching between those modes thanks to an effective switching mechanism.

These and other objects are achieved by a portable lamp, such as a headlamp, comprising:

at least one light source;

an electrical power source, a first state corresponding to at least one activated state in which the electrical power source is coupled to the at least one light source to generate a light beam;

a second state corresponding to a deactivated state wherein the electrical power source is not coupled to the at least one light source and no light beam is generated;

a third state corresponding to a locked state in which the electrical power source is not coupled to the at least one light source and no light beam is generated;

a switching mechanism configured to receive at least a first and a second physical user input through at least one switching element;

a processor coupled to the switching mechanism and being configured to select one among said first, second and third states in response to said physical user inputs;

wherein the processor is configured to correlate at least an alternative of two different physical user inputs for controlling a state change between said third state and said first state.

Thanks to such arrangement, there is the possibility of providing different combinations of ways for unlocking the headlamp and re-activating the latter.

In one embodiment, the switching element is a button and said first physical user input is a short push and said second physical user input is a long push.

Preferably, the processor is configured to control a state change from the locked state to said activated state from one of the following physical user inputs:

a long push on each of the first button and the second button;

a combination of four short pushes occurring within a predetermined time window on the first button In one embodiment, the headlamp includes a first and a second switching elements respectively corresponding to a first and a second button respectively located on the top and the side of the headlamp, each button providing the following two distinctive physical user inputs: a short push; a long push.

In one embodiment, the headlamp is configured to provide a first activated state corresponding to a reactive lighting based on the control of the brightness in response to the sensing of the reflected light, and a second activated state corresponding to a constant light beam.

Preferably, the headlamp is configured to provide a third activated state corresponding to the generation of red light.

In one embodiment, the processor is configured to select said reactive lighting mode in response to a short push on said first button (top) with a cycling between different levels of intensity occurring in response to subsequent short pushes on said first button (top).

Preferably, the processor is configured to select said constant lighting mode in response to a short push on said second button (side) with a cycling between different levels of intensity occurring in response to subsequent short pushes on second first button (side).

The invention also provides a process for controlling the configuration of a headlamp comprising at least one light source, an electrical power source, wherein said process comprises:

providing a first state corresponding to at least one activated state in which the electrical power source is coupled to the at least one light source to generate a light beam;

providing a second state corresponding to a deactivated state wherein the electrical power source is not coupled to the at least one light source and no light beam is generated;

providing a third state corresponding to a locked state in which the electrical power source is not coupled to the at least one light source and no light beam is generated;

providing a switching mechanism configured to receive at least a first and a second physical user input through at least one switching element;

providing a processor coupled to the switching mechanism and being configured to select one among said first, second and third states in response to said physical user inputs;

wherein the processor is configured to correlate at least one alternative of two physical user inputs for controlling a state change between said third state and said first state.

BRIEF DESCRIPTION OF THE DRAWINGS

Other features, objects and advantages of the invention will appear on reading the description and the following drawings, given solely by way of non-limiting examples, with reference being made to the accompanying drawings.

DESCRIPTION

There will now be described embodiments of a portable lamp, such as a headlamp which can advantageously incorporate an improved locking and unlocking mechanism which can be more easily incorporated into an effective user interface and which prevents unintended use of the battery.

1. Definitions

Physical user input shall designate a physical action or movement made by the user, which may include sliding, pushing etc. . . . . A long push on a physical button shall be one physical user input while a short push shall be another physical user input. Therefore, one mechanical or electrical switching element may provide one or more physical user inputs and the present invention may be implemented in various portable lamps, such as headlamps showing a variable number of switching elements or devices. The invention, may even be implemented in a lamp having a single push button which is configured to provide at least two distinctive physical user interfaces, such as a long push, a short push, a sequence of three short pushes, or four short pushes within a predetermined period of time etc. . . . .

A switching mechanism shall designate a hardware element configured for receiving one ore more physical inputs from a user and for controlling the switching of the system into various states of operation.

States of operation shall designate the various states of configuration of the system corresponding to different modes of operation, including various possibilities of illumination of the system (colors, intensity etc . . . ).

A LOCK state designates one state of operation wherein no current is significant drawn from the battery so as to allow storage of the lamp for quite a long time. In addition, the lock state is configured so as to offer to the user a specific arrangement for avoiding unintentional use of the battery or at least for minimizing the exposure of such unintentional use.

A OFF state designates one state of operation wherein, as in the LOCK state, no current is significantly drawn from the battery. However, contrary to the LOCK state, the OFF state does not provide any specific arrangement for avoiding unintentional use of the battery. The OFF state shows the possibility for a user to save the battery, while keeping the opportunity to rapidly re-activating the headlamp.

User interface: shall designates the general algorithm and processes for controlling the switching between the various states of the system in response of the different physical user inputs.

2. Description of a First Embodiment Comprising Two Switching Elements

Figure 1:
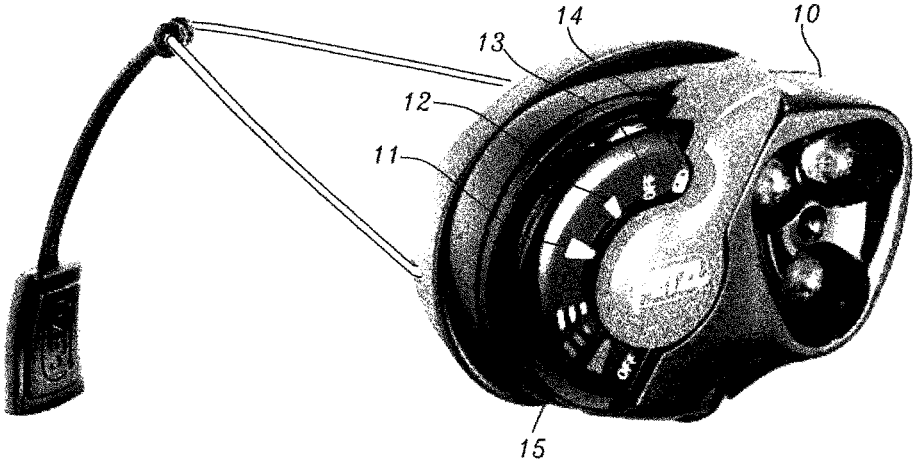
FIG. 1 Prior Art
FIG. 1 illustrates a conventional prior art headlamp fitted with a mechanical locking mechanism.
Figure 2:
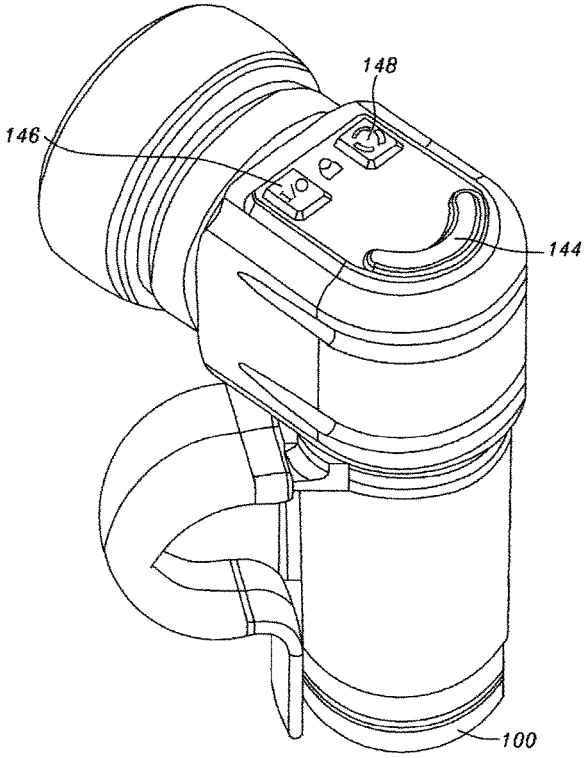
FIG. 2 Prior Art
FIG. 2 illustrates another conventional prior art headlamp fitted with an electrical locking mechanism.
Figure 3:
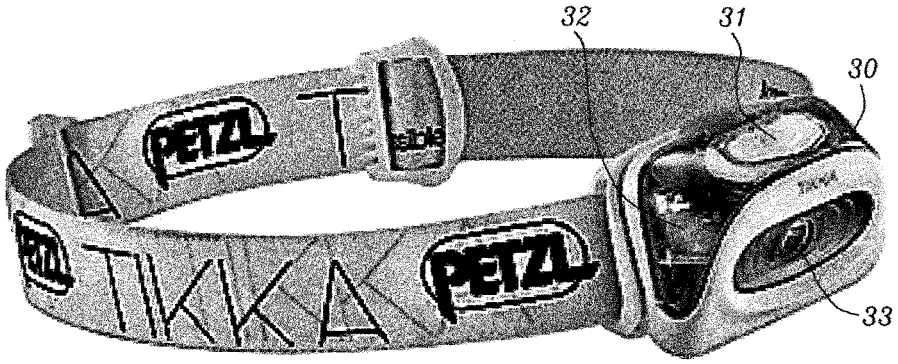
FIG. 3 illustrates a first embodiment of a headlamp configured to receive the improved locking mechanism.

With respect to FIG. 3, there will now be described one embodiment of a portable illumination system, such as a headlamp 30, configured to generate an optical light beam by means of an optical output device 33, e.g. comprising one or more LED. The headlamp includes two control buttons 31 and 32, respectively located at the top and on a side of the headlamp and an algorithm configured for detecting short pushes (e.g. less than 3 seconds) and long pushes (e.g. >3 seconds) on those buttons 31-32 so as to achieve quite a number of different possibilities of configurations of the headlamp, as described below. The different configurations or modes of operation include a first de-activated state (OFF), a LOCK state and at least one activated state wherein the headlamp is configured for generating light which may take various forms, patterns, intensities and colors, as will be described hereinafter with more details With respect to FIG. 4, one embodiment of the locking/unlocking process will now be described in detail. Similarly to the conventional systems, the portable illumination system is configured to have two particular states, respectively OFF and LOCK, showing no (significant) use of the battery. The OFF state corresponds to a momentary switch off of the headlamp which may be followed, more or less rapidly, by a re-activation of the latter. On the contrary the LOCK state corresponds to a state wherein the user considers that the system should be stored for quite a long time and preserved from any unintentional use of the system.

Figure 4:
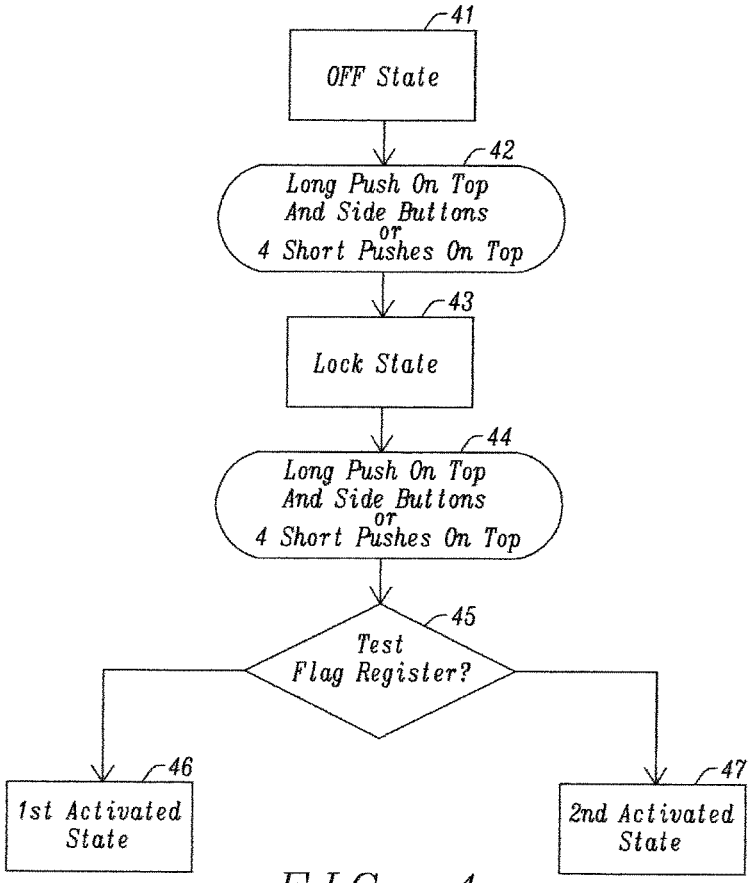
FIG. 4 is one embodiment of a locking/unlocking mechanism used in the lamp of FIG. 3.

In FIG. 4, state OFF is represented by a block 41. For the purpose of switching the headlamp into the state LOCK, the user may enter a combination of different physical inputs, for instance two long pushes onto buttons 31 and 32, respectively located on the Top and on the Side, wherein one long push on each button. Alternatively, the switching from OFF state to LOCK states may also result from the use of four distinctive short pushes on top button 31.

The entering of those different possibilities of user inputs is detected by the process in step 42 of FIG. 4, thus entailing the process to proceed to a step 43, corresponding to the switching of the lamp to a LOCK state.

Figure 5:
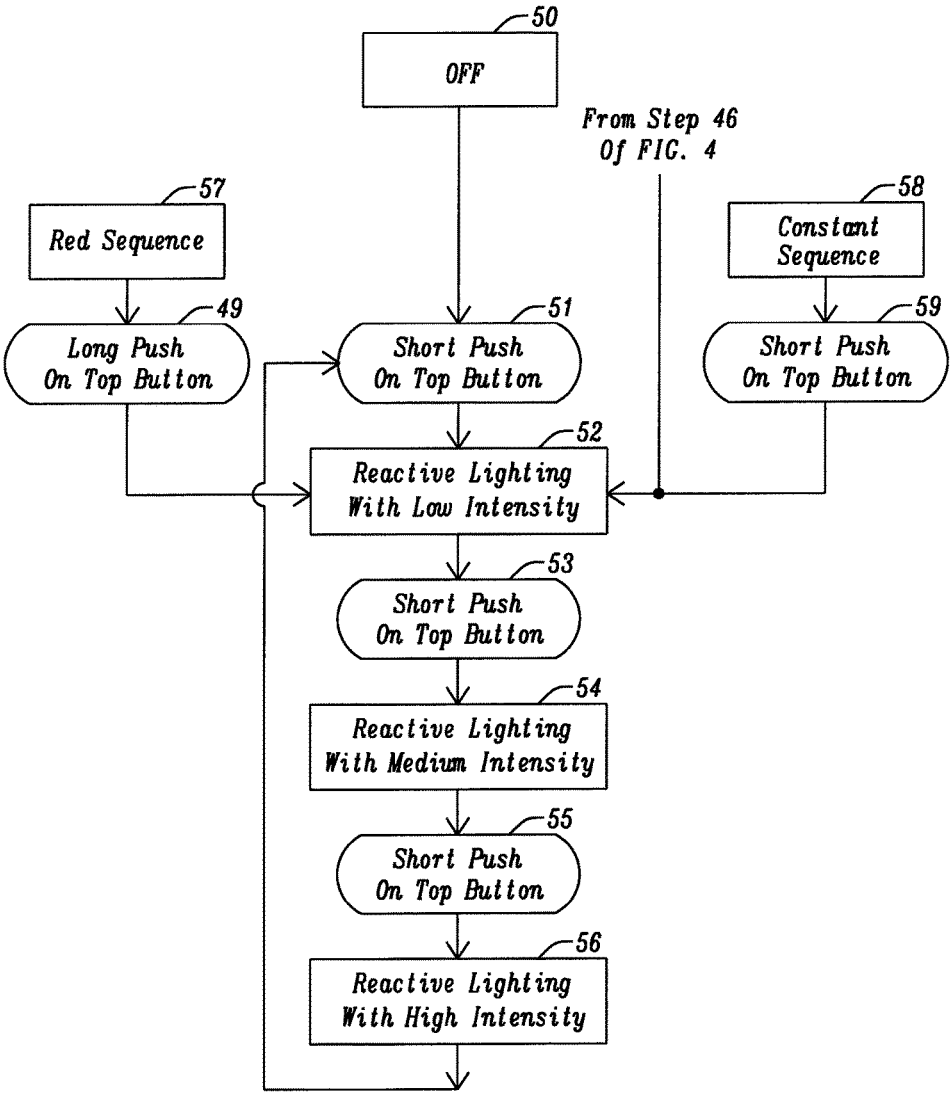
FIG. 5 is a flow chart illustrating one embodiment of the reactive lighting mode sequence.
Figure 7:
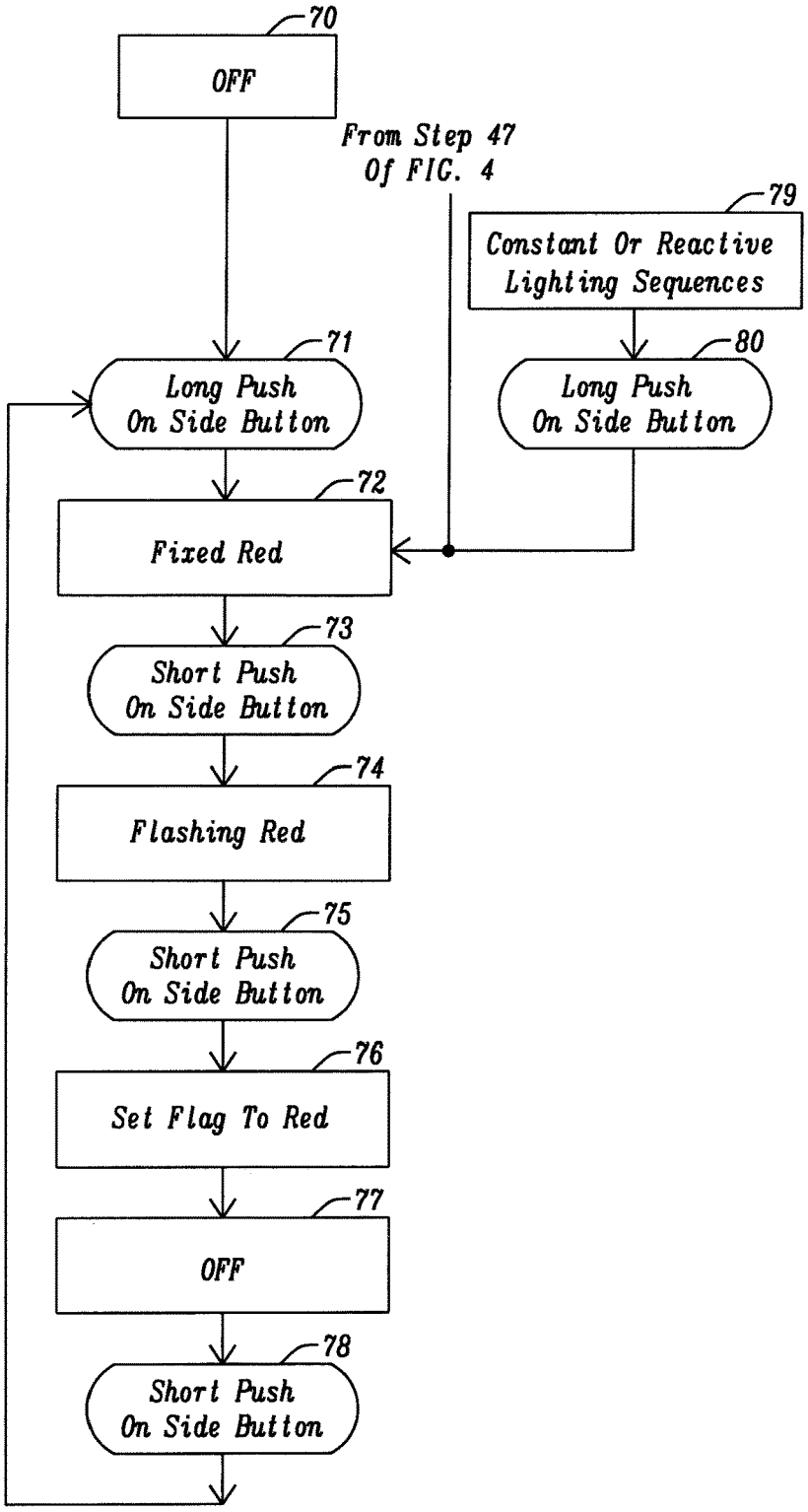
FIG. 7 is a flow chart illustrating one embodiment of the red lighting sequence.

Conversely, the portable illumination system can be switched from the LOCK state 43 to at least one or more activated states 46 and 47. To achieve this, the system is configured to respond to a configuration of physical user inputs, detected by a step 44, so as to proceed to a test 45 wherein a particular flag register is tested so as to let the process determine in which particular activated state the system should be configured. In one embodiment, the flag register is used to store a value representative of a "Red" or "white" color determining whether the portable illumination device is to be re-activated and configured into a reactive lighting mode as shown in FIG. 5 or a red lighting mode as shown in FIG. 7.

In the embodiment illustrated in FIG. 4, one sees that the unlocking of the headlamp results from the combination of two long pushes onto buttons 31 and 32, respectively located on the Top and on the Side. Alternatively, as above, the unlocking of the headlamp can also result from the use of four distinctive short pushes on top button 31 corresponding to another different physical user input.

Therefore, it can be seen that, in contrary to the conventional system known in the art, and particularly U.S. Pat. No. 8,529,086 "wherein the processor is configured to correlate only the second physical user input with a state change between the locked state and either one of the first activated state or the deactivated state", the unlock of the illumination device can be achieved, thanks to the invention, through the use of different physical user inputs.

Therefore, there is a clear advantage provided by the invention since the portable illumination system can be more easily unlocked in quite various modes of operations, while still minimizing the risk of any unintentional use of the battery.

Consequently, the locking/unlocking mechanism of the invention significantly deviates from the known system for providing a more effective unlocking mechanism which can be used in a more effective user interface.

With respect to FIG. 5, there is now described a first mode of operation which is the so-called "reactive lighting mode", which is based on the use of a sensor for sensing the light reflected by an object illuminated by the headlamp so as to allow the control of the brightness of the lamp, as described in patent application FR2930706 dated Apr. 24, 2008. More particularly, in accordance with the "reactive lighting", the brightness and beam pattern of the lamp are adapted so as to meet the requirements of minimum burn time chosen by the user. This innovative technology works on headlamps equipped with a rechargeable battery and is particularly designed for intensive use.

The process of the user interface of FIG. 5 starts with a step 50 which corresponds to the OFF state of the portable illumination system.

Then, in a step 51, the process waits for the entering of a physical user input corresponding to a short push on a top button, what results in the process to proceed to a step 52 where the headlamp is activated and configured in a first configuration mode corresponding to the so-called "reactive lighting mode" with the generated light beam being set to a first level of low intensity It should be noticed that step 52 also corresponds to the step 46 of FIG. 4 so that the unlocking of the headlamp in FIG. 4 can directly lead in one of the two activated states being step 52 corresponding of the reactive lighting with the lower level of intensity. Additionally, step 52 may also results from the detection, in a step 59, of a short actuation or push on Top button 31 when the headlamp is configured in the Constant sequence illustrated in FIG. 6. Furthermore, step 52 may finally follow the detection, in a step 49, of a long push on Side button 32 when the headlamp is configured in the red sequence which will be described in detail with respect to FIG. 7.

Following step 52, the process then proceeds to a step 53, where it waits for the entering of a physical user input corresponding to a further short push on the top button, what results in the process to proceed to a step 54, wherein the headlamp is configured in a reactive lighting mode with a higher intensity corresponding to MEDIUM.

Then, in a step 55 the process waits for the entering of a physical user input corresponding to an additional short push on the top button, what results in the process to proceed to a step 56, wherein the headlamp is configured in a reactive lighting mode with still a higher intensity corresponding to HIGH.

The process then proceeds to step 51 again, so as to wait for a new physical user input corresponding to a short push on the top button, so as to cycle again to LOW-MEDIUM-HIGH.

Consequently, it can be seen that the actuation with short pushes of the top button—which correspond to the most natural human interface with the headlamp, allows the user to configure the headlamp to cycle within the most effective mode, being the "reactive lighting mode", switching between different levels of intensity LOW, MEDIUM, HIGH involved within the considered sequence . . . Clearly, a skilled man could easily adapt the teaching of the description to the provision of more than three levels of intensity to be provided within the reactive lighting sequence of FIG. 5.

Another significant advantage resulting from such cycling process results from the fact that the cycling does not involve the OFF state (in contrary to the red sequence which will be described below), thus minimizing the exposure of the user to a loss of light in the particular case where he wishes to switch to another level of intensity within the reactive lighting sequence.

Figure 6:
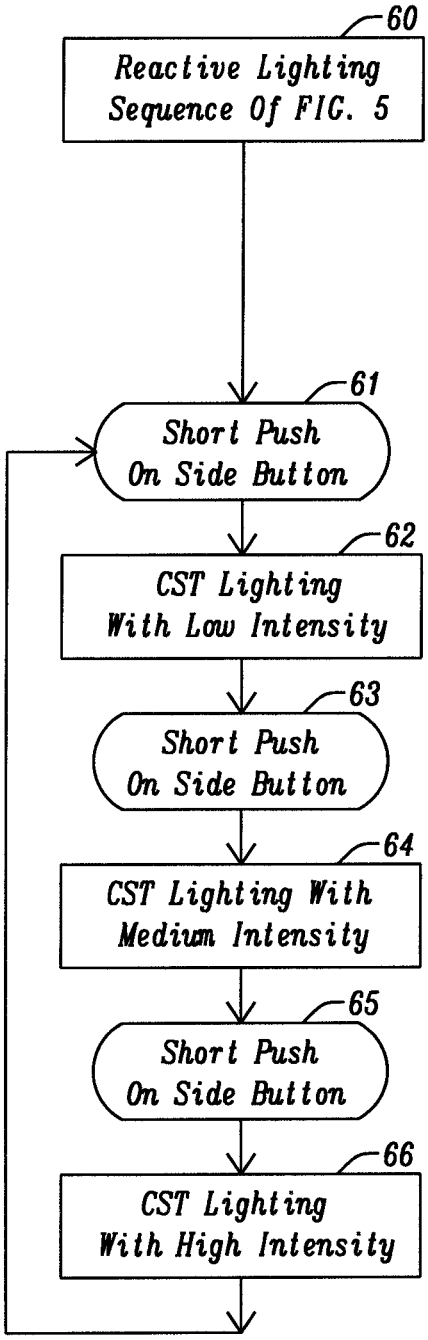
FIG. 6 is a flow chart illustrating one embodiment of the so-called constant mode lighting sequence.

With respect to FIG. 6, there is now described a second mode of operation—so-called CONSTANT (CST) mode or sequence—wherein the reactive lighting is de-activated so as to generate, for each step composing the CST mode, a constant illumination.

The process of the user interface of FIG. 6 starts with a step 60 which corresponds to anyone of the steps 51-56 of the Reactive lighting sequence.

Then, in a step 61, the process waits for the entering of a physical user input corresponding to a short push on side button 32, what results in the process to proceed to a step 62 where the headlamp is activated and configured in a second configuration mode which is the conventional "constant" mode, with a low intensity level being constant and not depending on the reflective light of the illuminated object.

Then, in a step 63, the process waits for the entering of a physical user input corresponding to a further short push on the side button, what results in the process to proceed to a step 64, wherein the headlamp is configured in a constant lighting mode with a higher intensity corresponding to MEDIUM level.

Then, in a step 65 the process waits for the entering of a physical user input corresponding to an additional short push on the side button, what results in the process to proceed to a step 66, wherein the headlamp is configured in a constant lighting mode with still a higher intensity corresponding to HIGH level of intensity.

The process then proceeds to step 61 again, so as to wait for a new physical user interface corresponding to a short push on the side button, so as to cycle again to LOW-MEDIUM-HIGH within the so-called CONSTANT sequence.

Consequently, it can be seen that the actuation with short pushes of the side button allows the user to configure the headlamp to cycle within the so-called CONSTANT mode or sequence between the different levels of intensity LOW, MEDIUM, HIGH . . . Clearly, a skilled man could easily adapt the teaching of the description to the provision of more than three levels of intensity to be provided within the CONSTANT sequence of FIG. 6.

Also, in one particular embodiments, the levels of intensity used in the reactive lighting sequence and within the constant sequence of FIGS. 5 and 6, respectively, are chosen to be different.

With respect to FIG. 7 there is now described a third mode of operation which is the so-called red mode, which is based on the generation of a light beam of red color, useful when the user wishes to generate a quiet lighting without disturbing any other persons. This mode may be used, for instance, when the user wishes to read a document without disturbing any other people.

In contrary to the CST mode—requiring a short push on the side switch when in reacting lighting mode—the user interface is arranged for allowing the user to enter into the red sequence directly from the OFF state, so as to prevent any unintentional disturbance of the other people for instance.

The process of the user interface of FIG. 7 starts with a step 70 which corresponds to the OFF state of the headlamp.

Then, in a step 71, the process waits for the entering of a physical user input corresponding to a long push on side button 32, what results in the process to proceed to a step 72 where the headlamp is activated and configured in the third configuration mode being the red mode. It should be noticed that step 72 also corresponds to the step 47 of FIG. 4 so that the unlocking of the headlamp in FIG. 4 can directly lead in this third mode depending on the value of the flag stored within the register/memory tested in step 45. Additionally, step 72 may also result from the detection, in a step 80, of a Long actuation or push on Side button 31 when the headlamp is configured in either one of the two Reactive Lighting or Constant Lighting sequences of FIGS. 5 and 6, respectively.

Then, in a step 73, the process waits for the entering of a physical user input corresponding to a further short push on the side button, what results in the process to proceed to a step 74, wherein the headlamp is configured so as to generating a flashing red light beam.

Then, in a step 75 the process waits for the entering of a physical user input corresponding to an additional short push on the side button, what results in the process to proceed to a step 76, wherein the flag register is set to correspond to RED value. The process then proceeds to a OFF state, with an extinction of the red light in a step 77.

The process then proceeds to a step 78 so as to wait for a new physical user interface corresponding to a short push on the Side button, during a period of less than 5 seconds, for instance, and to go back again to step 71.

Consequently, it can be seen that the actuation with short pushes of the side button 32 allows the user to configure the headlamp to cycle within the "red" sequence between the different modes: red, flashing red, storage within the flag and then OFF.

Clearly, a skilled man could easily adapt the teaching of the description to the provision of more complex operations or steps to be provided within the red sequence.

Figure 8:
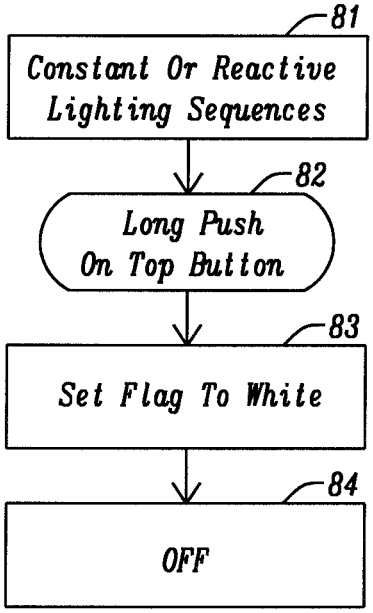
FIG. 8 is a flow chart of an embodiment of the Flag update mechanism to White.

FIG. 8 shows the flow chart involved for de-activating the headlamp when in reactive or Cst lighting modes, comprising the setting of the flag register to a value corresponding to White to be used for a subsequent possible unlocking of the system.

The process starts with a step 81 which corresponds to any step of the reactive lighting sequence of FIG. 5 or the constant lighting sequence of FIG. 6.

The process then proceeds to a step 82 where it waits for the entering of a physical user input corresponding to a long push of the top button 31, what results in setting of the flag register to a value corresponding to White.

The process then proceeds, in a step 84, to a OFF state with the power-off of the light.

The processes which were described above shows how effective may be the user interface which achieves a configuration of the headlamp among one of the three sequences: reactive lighting; constant sequence and red sequence. Such a process is particularly adapted when the headlamp is powered by a rechargeable battery which may advantageously use the reactive lighting for ensuring a predetermined time of operation of the headlamp.

In some cases, the headlamp may be fitted with an additional battery pack for using non rechargeable batteries for providing an alternative source of power for the lamp.

In one embodiment, the headlamp is configured for detecting the presence of such a battery pack, fitted for non rechargeable battery, and for configuring the headlamp for providing only two different modes: a constant mode and a red mode as will now be described in FIG. 9.

Figure 9:
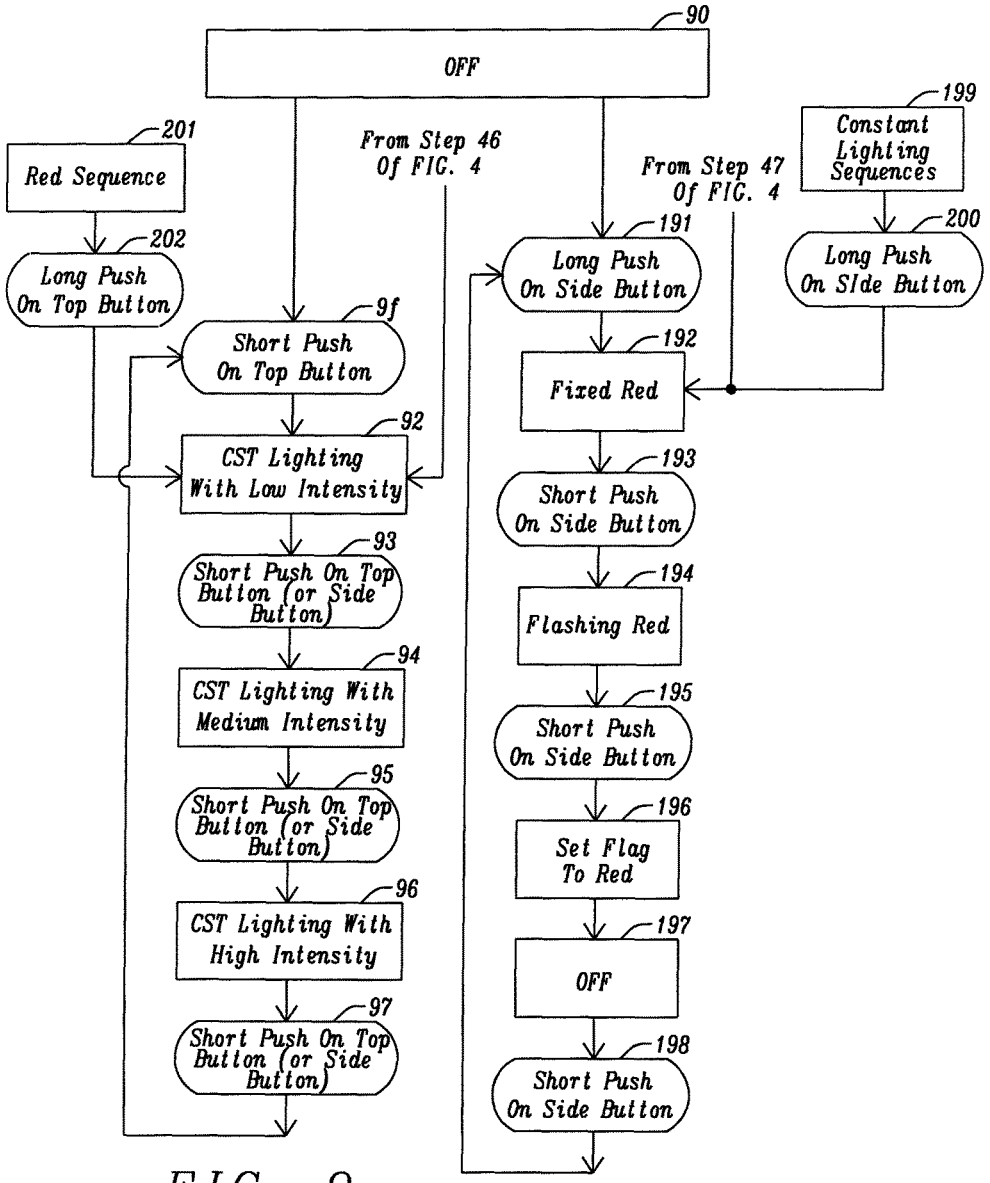
FIG. 9 is an illustrative flow chart of an embodiment of the user interface used for a non-rechargeable battery pack.

The process of the user interface of FIG. 9 starts with a step 90 which corresponds to the OFF state of the portable illumination system.

Then, in a step 91, the process waits for the entering of a physical user input corresponding to a short push on a top button 31, what results in the process to proceed to a step 92 where the headlamp is activated and configured in the CST mode, with a low level of intensity. It should be noticed that step 92 also corresponds to the step 46 of FIG. 4 so that the unlocking of the headlamp in FIG. 4 can directly lead in one of the configuration of the headlamp into the CST mode with the lower level of intensity for the light beam. Additionally, step 92 may also results from the detection, in a step 201, of a long push on the side button 32 when the headlamp is configured in the red lighting mode Subsequent to step 92, the process then proceeds to a step 93, where it waits for the entering of a physical user input corresponding to a further short push on either the top or side buttons, what results in the process to proceed to a step 94, wherein the headlamp is configured in CST mode with a MEDIUM intensity level.

Then, in a step 95 the process waits for the entering of a physical user input corresponding to an additional short push on either the top button or side buttons, what results in the process to proceed to a step 96, wherein the headlamp is configured in the CST lighting mode with a high level of intensity.

The process then proceeds to a step 97, where it waits for the entering of a physical user input corresponding to a further short push on either the top or side buttons, what results in the process to return to step 92 where the headlamp is configured in CST mode with a low intensity level.

Therefore, it can be seen that a short pushing of anyone of the two buttons 31 or 32 entails the cycling within the CST sequence between the different levels: LOW, MEDIUM and HIGH.

Referring back to FIG. 9, one further sees that the red mode is initiated with a step 191 wherein the process waits for the entering of a physical user input corresponding to a long push on side button 32, what results in the process to proceed to a step 192 where the headlamp is activated and configured in the red lighting sequence or mode. It should be noticed that step 192 also corresponds to the step 47 of FIG. 4 so that the unlocking of the headlamp in FIG. 4 can directly lead in the red lighting mode when the flag register stores a value corresponding to the red color. Additionally, step 192 may also result from the detection, in a step 200, of a Long push on Side button 31 when the headlamp is configured in any step belonging to the CST lighting sequence.

Then, in a step 193, the process waits for the entering of a physical user input corresponding to a further short push on the side button, what results in the process to proceed to a step 194, wherein the headlamp is configured so as to generate a flashing red light beam.

Then, in a step 195 the process waits for the entering of a physical user input corresponding to an additional short push on the side button, what results in the process to proceed to a step 196, wherein the flag register is set to correspond to RED value. The process then proceeds to a OFF state, with an extinction of the red light in a step 197.

The process then proceeds to a step 198 so as to wait for a further short push on the Side button, during a period of less than 5 seconds, for instance, and to go back again to step 192.

It should be noticed that, similarly as above with the process of FIG. 8, the de-activation of the headlamp (OFF) when in Cst lighting mode results from the detection of a long push of the top button 31, what entails a setting of the flag register to WHITE before the headlamp enters in OFF state.

3. Description of a Second Embodiment Comprising One Single Switching Element

In order to illustrate the wide possibilities of application of the teaching of the invention, one will now describe a second embodiment comprising a headlamp fitted with one single switching element, providing at least a first, a second and a third physical user input etc . . . For instance, the second embodiment may use a push button which is associated with a control unit located within the portable headlamp so as to detect the following three physical user inputs:

first physical user input: a short push on the single button;

second physical user input: a long push on the single button;

third physical user input: a sequence of four short pushes within a time window, etc. . . . .

In the embodiment represented in FIGS. 10, 11, 12*a* and 12*b*, the headlamp is configured to provide a constant white lighting of three predetermined intensities (low, medium, high), as well as a facility to swap into three distinctive colors: red, green and blue. The locking/unlocking mechanism allows the possibility to ensure safe locking of the headlamp while ensuring the possibility to unlock the headlamp and directly configure the latter in the appropriate color (white, red). Providing the significant advantage that a headlamp which was locked when in red lighting shall be automatically reactivated in the same color.

Figure 10:
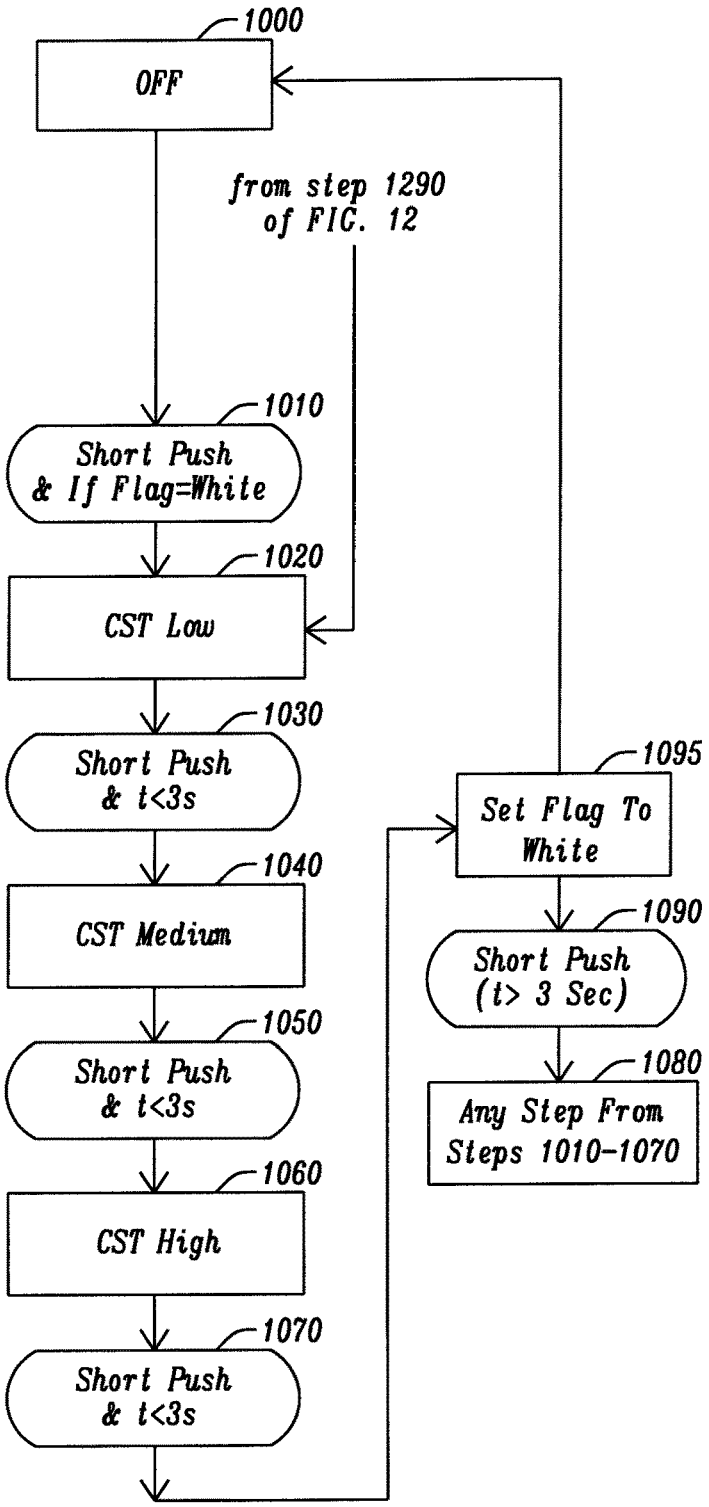
FIGS. 10, 11, 12*a* and 12*b* illustrate a second embodiment of a headlamp fitted with a single button and configured to receive the improved locking mechanism.

With respect to FIG. 10, one sees that the process starts with a step 1000 where the headlamp is assumed to be in a OFF state.

Then the process proceeds to a step 1010 where it waits for a short push during a period inferior to 3 seconds (as an example). If such short push occurs and if the flag register is set to white, then the process proceeds to a step 1020 where the headlamp is configured in constant lighting with a level of brightness being set to low. It should be noticed that step 1020 may also be reached from step 1290 of FIG. 12, as described hereinafter.

Then, the process proceeds to a step 1030 where it waits again the occurrence of a short push (with $t<3$ seconds), what results in the configuration of the headlamp to provide a constant lighting with a brightness set to Medium, in step 1040.

Then, the process proceeds to a step 1050 where it waits again the occurrence of a short push (with t<3 seconds), what results in the configuration of the headlamp to provide a constant lighting with a brightness set to high level, in step 1060.

Then, the process proceeds to a step 1070 where it waits again the occurrence of a short push (with t<3 seconds), what results in the process proceeds to step 1095 wherein the flag register is set to store a value representative of "WHITE" color.

It should be noticed that step 1095 may be also reached with the occurrence of a short push with a period of more than 3 seconds during anyone one of steps 1010-1070 (steps 1080-1090).

Figure 11:
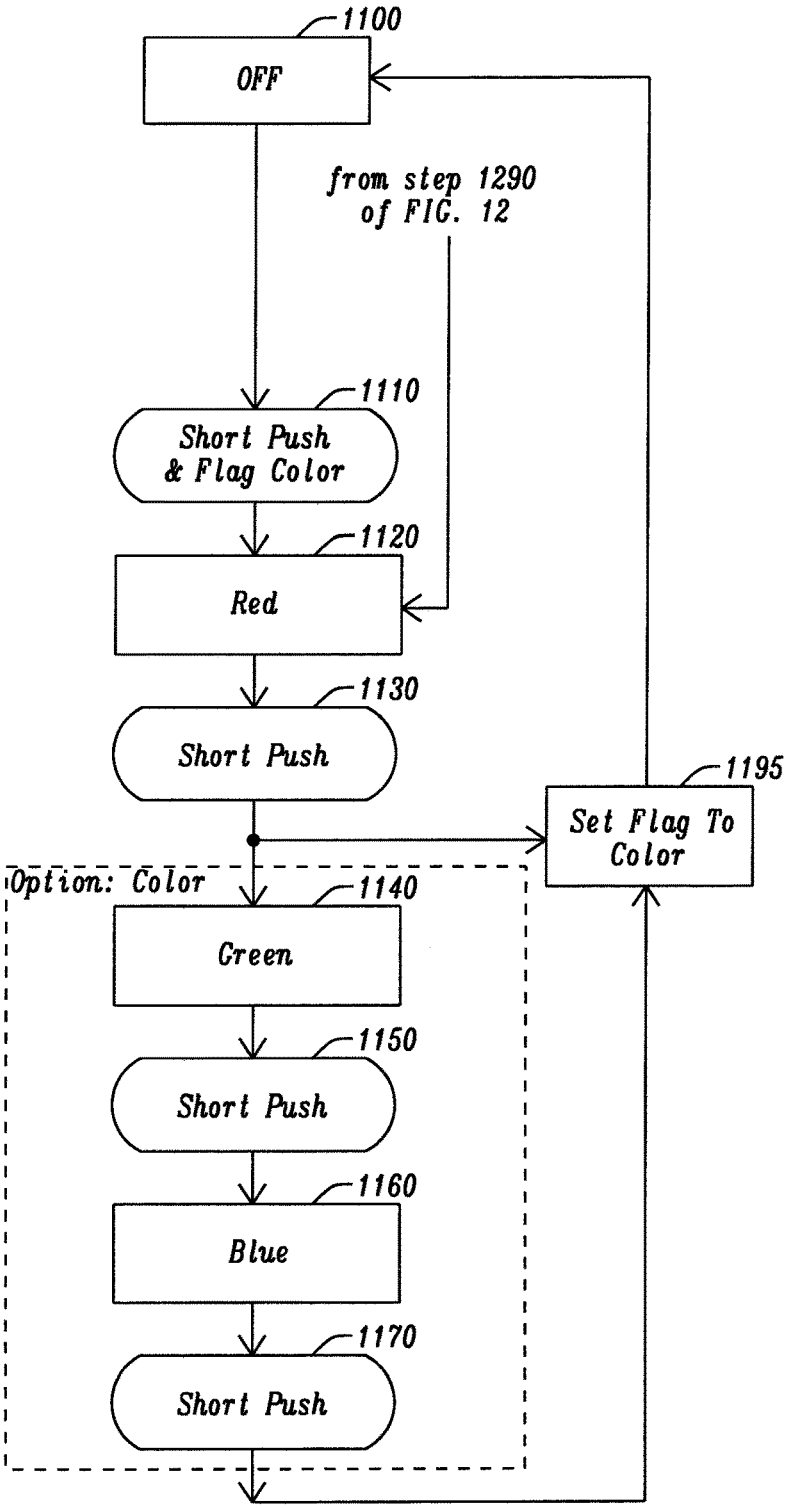

FIG. 11 illustrates the process of the user interface used for providing a colored light beam. The process starts with a step 1100 where the headlamp is assumed to be in a OFF state.

Then the process proceeds to a step 1110 where it waits for a short push during a period inferior to 3 seconds. If such short push occurs and if the flag register is set to "color", then the process proceeds to a step 1120 where the headlamp is configured in constant lighting in red. It should be noticed that step 1120 may also be reached from step 1291 of FIG. 12 which will be described hereinafter with more details.

Then, the process proceeds to a step 1130 where it waits again the occurrence of a short push (with t<3 seconds), what results in the configuration of the headlamp to provide one among two options.

If the headlamp is assumed to support color swapping, then the occurrence of a short push (with t<3 seconds) in step 1130 causes the process to proceed to a step 1040 where the headlamp is configured to generate a light beam in green color.

Then, the process proceeds to a step 1150 where it waits again the occurrence of a short push (with t<3 seconds), what results in the headlamp being configured to generate a blue light beam, in a step 1160.

Then, the process proceeds to a step 1170 where it waits again the occurrence of a short push (with t<3 seconds), what results in the process to proceed to step 1195 wherein the flag register is set to store a value representative of "Color".

Steps 1140-1170 were related to a headlamp supporting color swapping. In one particular embodiment, such swapping may not be supported, what results in the step 1130 of FIG. 11 to directly proceed to step 1195 for setting the flag register to the value "color" (corresponding to red, in that case).

Figure 12A:
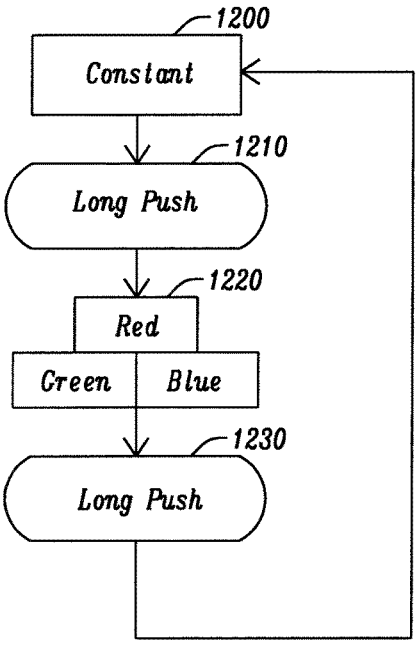

FIG. 12*a* illustrates one embodiment of the swapping process between the different colors (red, green, blue) which may be executed when the lamp is configured in constant mode (step 1200). One sees that a long push on the single button is correlated by the control unit located inside the lamp to perform a cycling between the three colors (step 1220). A final long push then entails the process to proceed, in a step 1230, to step 1200 corresponding to the constant white mode.

Figure 12B:
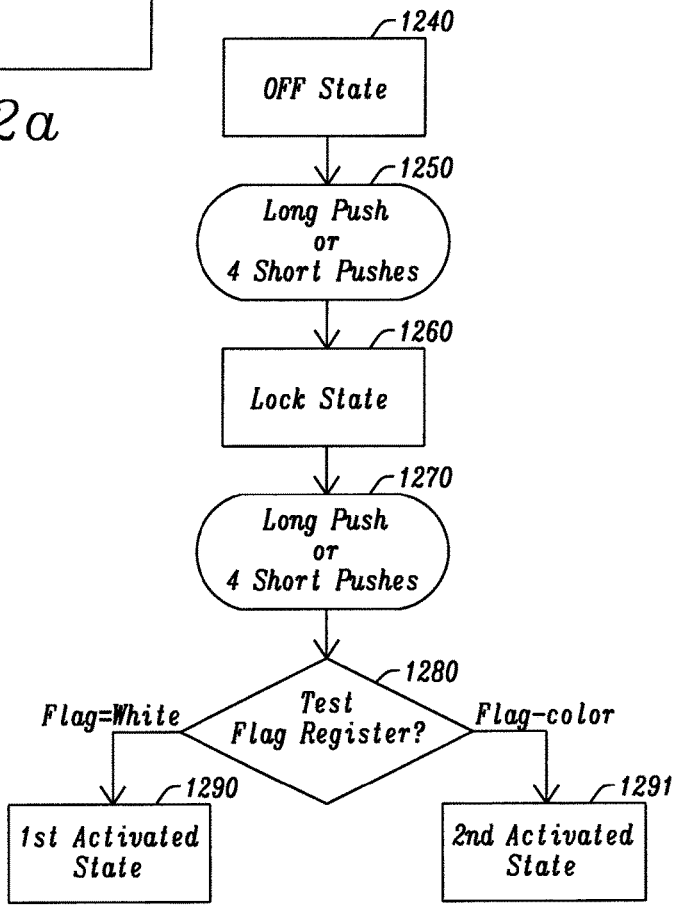

FIG. 12*b* shows the adaptation of the locking/unlocking mechanism to the second embodiments illustrated in FIGS. 10-11. As in FIG. 4, the process starts with a step 1240 which corresponds to the OFF state. The process then proceeds to a step 1250 where it waits for the entering of a long push on the single button or, alternatively, a sequence of four distinctive short pushes occurring on the same button.

The entering of those different possibilities of user inputs is detected by the process in step 1250 of FIG. 12*b*, thus entailing the process to proceed to a step 1260, corresponding to the configuration of the headlamp into the LOCK state.

Then, the process proceeds to a step 1270 where it waits for the occurrence of at least two distinctive physical user inputs, ie either a long push or a sequence of four short pushes (or any other combination of short pushes), what results in the process to proceed to a step 1280 which corresponds to the testing of the flag register.

If the flag register is detected to store a value representative of "white", then the process proceeds to a step 1290 where the headlamp is configured in the white mode and the process then proceeds to step 1020 of FIG. 10.

Conversely, if the flag register is detected to store a value representative of "color", then the process proceeds to a step 1291 where the headlamp is configured in the red mode and the process then proceeds to step 1120 of FIG. 11.

Again, it can be seen that, in contrary to the conventional systems mentioned above, the unlock of the illumination device can be achieved not only from one physical user inputs but also from a combination of different physical inputs.

One sees, again, the clear advantage of the locking/unlocking mechanism even when the headlamp only provides one single mechanical switching component.

The invention can be implemented in digital electronic circuitry, or in computer hardware, firmware, software, or in combinations of them. Portable illumination systems according to the invention can be advantageously implemented with the use of a programmable processor executing a computer program for the purpose of embodying the different steps of the processes described above. Each computer program can be implemented in a high-level procedural or object-oriented programming language, or in assembly or machine language if desired; and in any case, the language may be a compiled or interpreted language. Suitable processors include, by way of example, both general and special purpose microprocessors. Generally, a processor will receive instructions and data from a read-only memory and/or a random access memory. Generally, a computer will include one or more mass storage devices for storing data. Storage devices suitable for tangibly embodying computer program instructions and data include all forms of non-volatile memory, including by way of example semiconductor memory devices, such as EPROM, EEPROM, and flash memory devices. Any of the foregoing can be supplemented by, or incorporated in, ASICs (application-specific integrated circuits) which may also embody the switching mechanisms allowing the switching of the headlamp between the different states of operation.

A number of implementations of the invention have been described. Nevertheless, it will be understood that various modifications may be made without departing from tile spirit and scope of the invention. Accordingly, other implementations are within the scope of the following claims.

What is claimed is:

1. A headlamp comprising:

at least one light source;

an electrical power source, a first state corresponding to at least one activated state in which the electrical power source is coupled to the at least one light source to generate a light beam;

a second state corresponding to a deactivated state wherein the electrical power source is not coupled to the at least one light source and no light beam is generated;

a third state (Lock) corresponding to a locked state in which the electrical power source is not coupled to the at least one light source and no light beam is generated;

a switching mechanism configured to receive at least a first and a second physical user input through at least one switching element;

a processor coupled to the switching mechanism and being configured to select one among said first, second and third states in response to said first and second physical user inputs;

wherein the unlock of the headlamp is achieved through the use of different physical inputs, and wherein said switching mechanism further correlates a third physical user input different from said first and said second physical user input for switching of said third state (Lock) to said first state.

2. The headlamp according to claim 1 wherein said switching element is a button and said first physical user input is a short push and said second physical user input is a long push.

3. The headlamp according to claim 2 wherein the processor is configured to control a state change from the locked state to said activated state from the following one of physical user inputs:

a long push a combination of four short pushes occurring within a predetermined time window.

4. The headlamp according to claim 1 wherein the headlamp includes a first and a second switching elements respectively corresponding to a first and a second button respectively located on the top and the side of the headlamp, each button providing the following two distinctive physical user inputs: a short push; a long push.

5. The headlamp according to claim 4 wherein the processor is configured to control a state change from the locked state to said activated state from one of the following physical user inputs:

a long push on each of the first button and the second button;

a combination of four short pushes occurring within a predetermined time window on the first button.

6. The headlamp according to claim 1, wherein said headlamp is configured to provide a first activated state corresponding to a reactive lighting based on the control of the brightness in response to the sensing of the reflected light, and a second activated state corresponding to a constant lighting.

7. The headlamp according to claim 6 wherein the headlamp is configured to provide a third activated state corresponding to the generation of red light.

8. The headlamp according to claim 7 wherein the processor is configured to select said reactive lighting mode in response to a short push on said first button (top) with a cycling between different levels of intensity occurring in response to subsequent short pushes on said first button (top).

9. The headlamp according to claim 8 wherein the processor is configured to select said constant lighting mode in response to a short push on said second button (side) with a cycling between different levels of intensity occurring in response to subsequent short pushes on second first button (side).

10. The headlamp according to claim 9 wherein the processor is configured to select a red lighting mode in response to a long push on said second button (side) with a cycling between the following states in in response to subsequent short pushes on said second button (side):

fixed red flashing red storing into a flag register and OFF state.

11. A process for controlling the configuration of a headlamp comprising at least one light source, an electrical power source, wherein said process comprises the steps of:

providing a first state corresponding to at least one activated state in which the electrical power source is coupled to the at least one light source to generate a light beam;

providing a second state corresponding to a deactivated state wherein the electrical power source is not coupled to the at least one light source and no light beam is generated;

providing a third state (lock) corresponding to a locked state in which the electrical power source is not coupled to the at least one light source and no light beam is generated;

providing a switching mechanism configured to receive at least a first and a second physical user input through at least one switching element;

providing a processor coupled to the switching mechanism and being configured to select one among said first, second and third states in response to said physical user inputs;

wherein the unlock of the headlamp is achieved through the use of different physical inputs, and wherein said switching mechanism further correlates a third physical user input different from said first and said second physical user input for switching of said third state (Lock) to said first state.

12. The process of claim 11 wherein said switching element is under the form of a button and said first physical user input is a short push and said second physical user input is a long push.

13. The process of claim 12 wherein the processor is configured to control a state change from the locked state to said activated state from the following one of physical user inputs:

a long push a combination of four short pushes occurring within a predetermined time window.

14. The process of claim 11 wherein the headlamp provides a first and a second switching elements respectively corresponding to a first and a second button respectively located on the top and the side of the headlamp, and wherein the headlamp detects the following distinctive physical user inputs: a short push; a long push.

15. The process of claim 14 wherein the processor controls a state change from the locked state to said activated state from one of the following physical user inputs:

a long push on each of the first button and the second button;

a combination of four short pushes occurring within a predetermined time window on the first button.

16. The process of claim 11, wherein said headlamp provides a first activated state corresponding to a reactive lighting based on the control of the brightness in response to the sensing of the reflected light, and a second activated state corresponding to a constant light beam.

17. The process of claim 16 wherein the headlamp provides a third activated state corresponding to the generation of red light.

18. The process of claim 17 wherein the processor selects said reactive lighting mode in response to a short push on said first button (top) with a cycling between different levels of intensity occurring in response to subsequent short pushes on said first button (top).

19. The process of claim 18 wherein the processor selects said constant lighting mode in response to a short push on said second button (side) with a cycling between different levels of intensity occurring in response to subsequent short pushes on second first button (side).

20. The process of claim 19 wherein the processor selects a red lighting mode in response to a long push on said second button (side) with a cycling between the following states in in response to subsequent short pushes on said second button (side):

fixed red flashing red storing into a flag register and OFF state.

* * * * *